US008562206B2

(12) United States Patent
Bossart et al.

(10) Patent No.: US 8,562,206 B2
(45) Date of Patent: Oct. 22, 2013

(54) HAIRSPRING FOR TIMEPIECE HAIRSPRING-BALANCE OSCILLATOR, AND METHOD OF MANUFACTURE THEREOF

(75) Inventors: Richard Bossart, Lausanne (CH); Jerome Daout, Rolle (CH)

(73) Assignee: Rolex S.A., Geneva (CH)

( * ) Notice: Subject to any disclaimer, the term of this patent is extended or adjusted under 35 U.S.C. 154(b) by 208 days.

(21) Appl. No.: 13/179,079

(22) Filed: Jul. 8, 2011

(65) Prior Publication Data

US 2012/0008468 A1 Jan. 12, 2012

(30) Foreign Application Priority Data

Jul. 12, 2010 (EP) ..... 10405134

(51) Int. Cl.
*G04B 17/04* (2006.01)

(52) U.S. Cl.
USPC ..... 368/175

(58) Field of Classification Search
USPC ..... 368/175–178; 267/166–168
See application file for complete search history.

(56) References Cited

U.S. PATENT DOCUMENTS

| | | | | |
|---|---|---|---|---|
| 570,394 | A | 10/1896 | Griscom | |
| 2005/0281137 | A1 | 12/2005 | Bourgeois et al. | |
| 2008/0113154 | A1 | 5/2008 | Bitterli et al. | |
| 2009/0016173 | A1* | 1/2009 | Hessler et al. | 368/140 |
| 2010/0027382 | A1 | 2/2010 | Daout et al. | |
| 2010/0061192 | A1* | 3/2010 | Hessler et al. | 368/177 |
| 2011/0069591 | A1 | 3/2011 | Daout | |
| 2012/0075963 | A1* | 3/2012 | Zaugg | 368/127 |

FOREIGN PATENT DOCUMENTS

| | | | |
|---|---|---|---|
| EP | 1422436 | A1 | 5/2004 |
| EP | 1921518 | A1 | 5/2008 |
| EP | 2151722 | A1 | 2/2010 |
| EP | 2230570 | A2 | 9/2010 |
| EP | 2233989 | A1 | 9/2010 |
| EP | 2299336 | A2 | 3/2011 |

OTHER PUBLICATIONS

European Search Report of EP 10 40 5134, date of mailing Jan. 12, 2011.

* cited by examiner

*Primary Examiner* — Sean Kayes
(74) *Attorney, Agent, or Firm* — Westerman, Hattori, Daniels & Adrian, LLP

(57) ABSTRACT

The present invention relates to a hairspring for a timepiece hairspring-balance oscillator, which can be produced, in particular, from a low-density material such as silicon, diamond or quartz, and to a method of manufacturing such a hairspring. According to the invention, this hairspring comprises at least one leaf (2) the cross section of which has a thickness and a height and its characterizing feature is that the leaf (2) comprises a plurality of apertures (3) extending in the heightwise direction of the leaf and alternating with bridges (5). The invention also relates to a method of manufacturing such a hairspring.

14 Claims, 7 Drawing Sheets

HAIRSPRING FOR TIMEPIECE HAIRSPRING-BALANCE OSCILLATOR, AND METHOD OF MANUFACTURE THEREOF

The present invention relates to a hairspring for a timepiece hairspring-balance oscillator, which can be produced, in particular, from a low-density material such as silicon, diamond or quartz, and to a method of manufacturing such a hairspring.

The aforementioned low-density materials allow the hairspring to be given a complex geometry using microfabrication techniques, for example masking and etching of a silicon wafer.

The chronometrics performance of the hairspring is directly dependent on its mass, because the mass of the hairspring, as it expands and contracts, contributes to the forces applied to the balance pivots.

European patent application published under the number EP 1 921 518 describes an assembly element that can be fitted to a timepiece. This element comprises rectilinear elastic leaves and apertures (deflection openings) which are separated by bridges of material. It aims to improve the force with which it is bound against an arbor.

It is an object of the present invention to reduce the mass of a timepiece hairspring while at the same time maintaining a stiffness that is equivalent to that of a solid hairspring.

To this end, one subject of the present invention is a hairspring for a hairspring-balance oscillator, comprising at least one leaf the cross section of which has a thickness and a height, the characterizing feature of this hairspring being that the leaf comprises a plurality of apertures extending in the heightwise direction of the leaf and alternating with bridges.

Thus, by virtue of the invention, the mass of the leaf is reduced and this results in an improvement of the isochronicity of the hairspring-balance regulating mechanism.

According to one embodiment of the invention, the leaf forms turns and the apertures are distributed at least over the entire length of a turn.

According to another embodiment of the invention, the apertures are distributed over the entire length of the leaf.

The apertures may be distributed uniformly, either with a constant distance between bridges or with a constant angular pitch between bridges, or non-uniformly, with an angular pitch or distance between bridges that can vary, along the entire length of the turn or turns or of the entire leaf.

Advantageously, the apertures and the thickness of the leaf are dimensioned so that the stiffness of the leaf is the same as that of a reference leaf of given cross section but without apertures, this being advantageous in terms of the way in which the hairspring behaves in the event of a knock, given the reduction in its mass.

For preference, the apertures have an elongate shape and the leaf comprises two equidistant portions joined to one another and separated by the apertures. As an alternative form of embodiment, the apertures are of circular or elliptical shape.

In one embodiment, the two equidistant portions each have a thickness of a dimension less than half the thickness of the reference leaf and are separated at the apertures by a distance greater than half the thickness of the reference leaf without apertures.

For example, the thicknesses of the two equidistant portions of the leaf are each equal to one quarter of the thickness of the reference leaf, and the total thickness of the leaf is equal to 1.05 times the thickness of the reference leaf without apertures.

In one embodiment, the bridges are situated uniformly along the leaf with a constant angular spacing.

For preference, the angular spacing between the bridges that alternate with the apertures is chosen to be between 1° and 360°.

In one embodiment, the angular spacing between the bridges is 30° on the inner turns and 15° on the outer turns.

In another embodiment, the bridges are uniformly situated along the leaf with a constant distance between bridges.

Advantageously, the leaf is made of silicon, diamond or quartz. Alternatively, the leaf is made of a metal alloy, for example an Ni-based alloy.

In one embodiment, the leaf has a thickness that is constant along the turns.

In another embodiment, the leaf has a thickness that varies along the turns.

Advantageously, the leaf comprises a core and a layer of external material enveloping the core, these being configured in such a way that the ratio between the dimensions of the core and of the layer of external material remains constant along the leaf.

For example, the core of the leaf is made of silicon and the layer of external material is made of silicon dioxide $SiO_2$.

The invention also relates to a method of manufacturing such a hairspring.

The attached drawings illustrate, schematically and by way of example, one embodiment of a hairspring that forms the subject of the invention, and alternative forms of this embodiment.

The leaf of the hairspring is intended to be connected to a timepiece balance (not depicted) and it deforms elastically and concentrically as it contracts and expands as a result of oscillation of the hairspring-balance mechanism.

Figure 1:
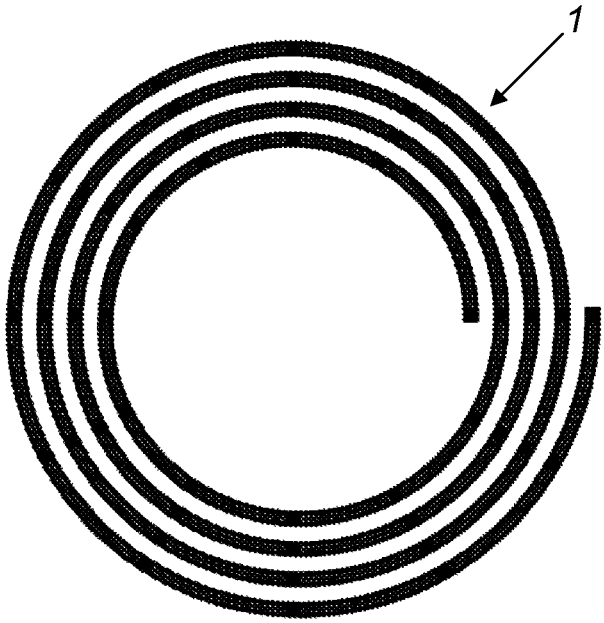
Fig. 1 PRIOR ART
FIG. 1 is a plan view of a portion of leaf of a hairspring of the prior art for a timepiece hairspring-balance oscillator.
Figure 3:
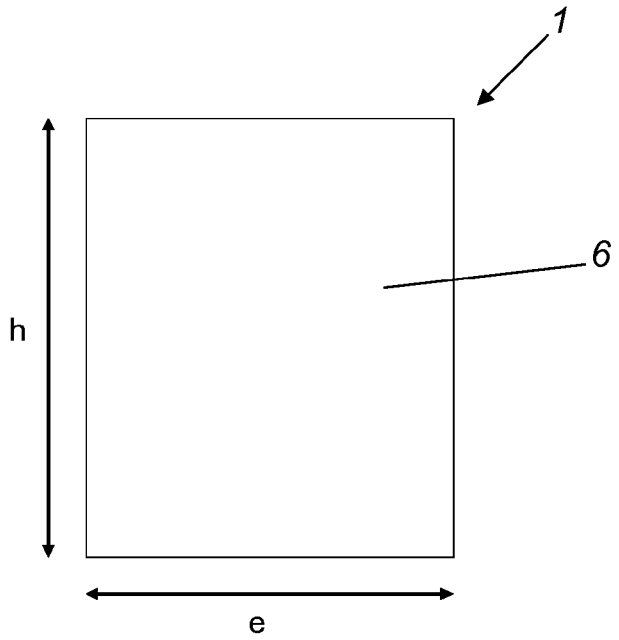
Fig. 3 PRIOR ART
FIG. 3 illustrates a cross section of the leaf of the hairspring of FIG. 1.

As depicted in FIGS. 1 and 3, a leaf 1 or strip of a hairspring of the prior art has a transverse cross section of rectangular shape, of height h and of thickness e, and has an internal end connected to a collet (not depicted) for securing it to the arbor of a balance and an external end connected to a fixed point of attachment (not depicted). The one-piece leaf 1 is referred to as the reference leaf 1 without apertures.

For preference, the hairspring is made of a low-density material such as silicon, diamond or quartz using microfabrication techniques that allow complex leaf geometries to be achieved, for example by masking, etching and cutting a silicon wafer.

The respective axial, radial and angular directions are used by convention to simplify the description and more or less correspond to the directions running respectively along the height of the cross section, along the thickness of the cross section and each turn of leaf.

Figure 2:
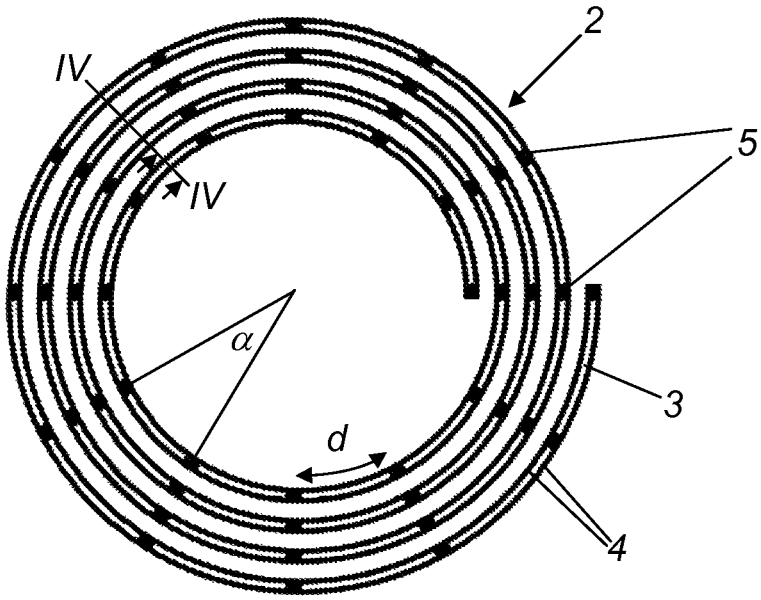
FIG. 2 is a plan view of one embodiment of a portion of leaf of a hairspring according to the invention for a timepiece hairspring-balance oscillator.
Figure 11:
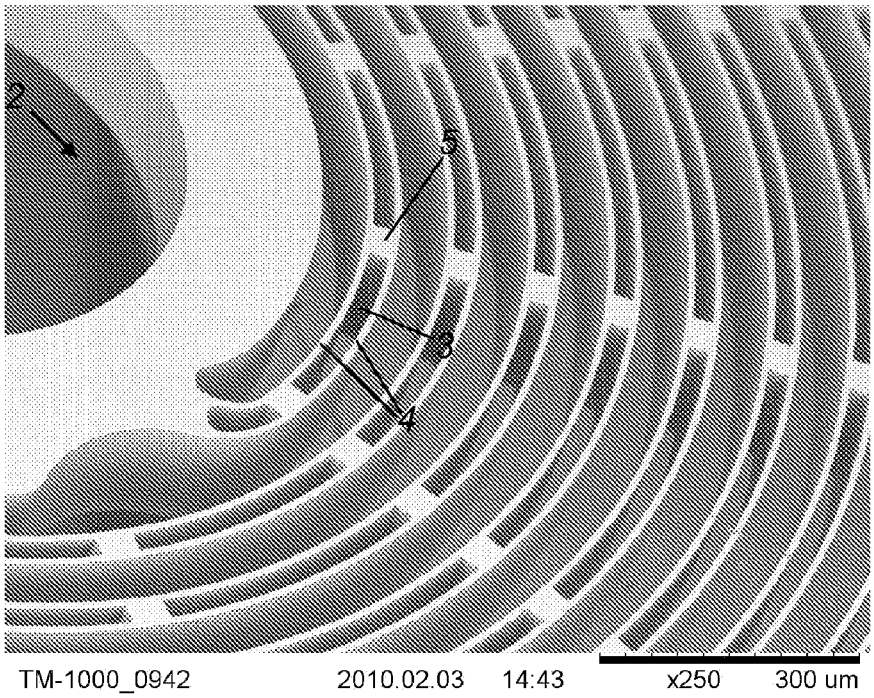
FIG. 11 is an enlarged view of the leaf of the hairspring according to the invention, produced as an electron micrograph.

The hairspring according to the invention and depicted in FIGS. 2 and 11 comprises a leaf 2 forming turns that have apertures 3 spaced uniformly along their entire length, in the thickness of the leaf, so as to reduce the mass/stiffness ratio and ultimately decrease the mass thereof.

Figure 4:
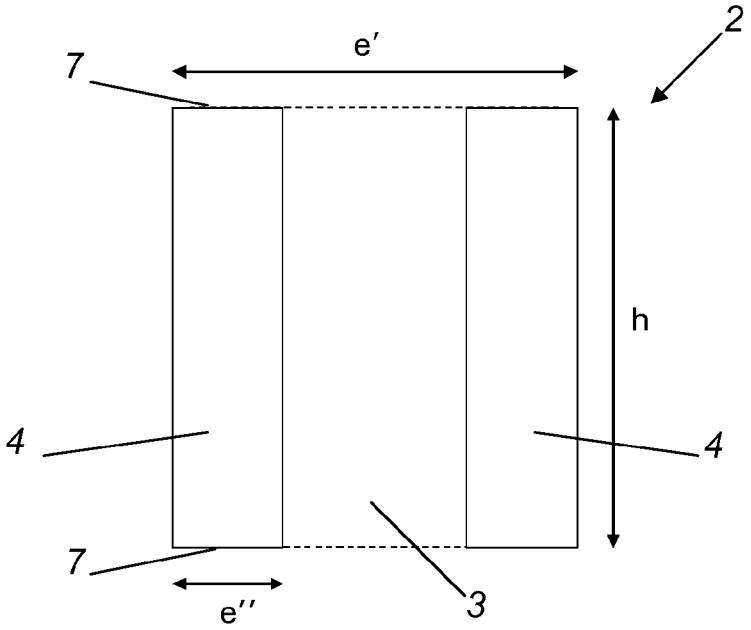
FIG. 4 illustrates a cross section on IV-IV of FIG. 2 of the leaf of the hairspring.

In other words, the apertures 3 pass axially through the leaf 2 in the heightwise direction of its cross section between two equidistant portions 4, this being better than illustrated in FIG. 4.

The apertures 3 are preferably of elongate shape. They are each situated between equidistant portions 4 of the leaf 2 that alternate with bridges 5 that join the two equidistant portions 4 together.

In the embodiment of the invention depicted in FIG. 2, the bridges 5 are uniformly distributed along the leaf 2 with angular spacing $\alpha$ of 30°, the arc length of the apertures 3 increasing toward the outside of the leaf 2 with each turn of the spiral that is the hairspring.

The angular spacing $\alpha$ between the bridges 5 may be chosen to be between 1° and 360°.

Figure 10:
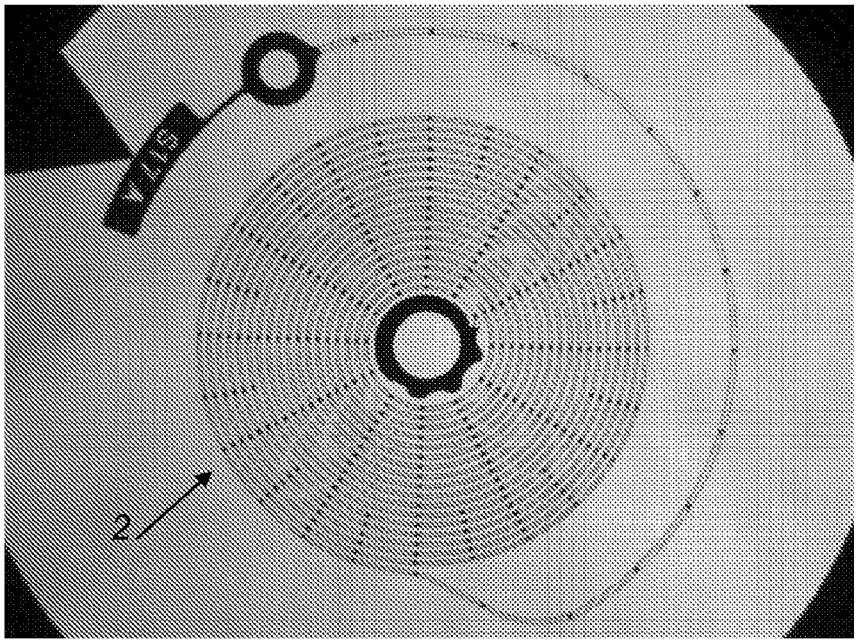
FIG. 10 is a plan view of one embodiment of the leaf of the hairspring according to the invention, produced by photomicroscopy using an optical microscope.

A different angular spacing $\alpha$ may be chosen for the inner turns and for the outer turns, as illustrated in FIG. 10, where the spacing is equal to 30° for the inner turns and to 15° for the outer turns. The spacing may also vary continuously, for example in order to keep a substantially constant distance d between two bridges along the turns.

The arrangement of the bridges 5, the dimensions of the apertures 3 and the thickness of the portions 4 are configured to ensure that the leaf 2 of FIG. 2 has the same stiffness as the reference leaf 1 without apertures.

As illustrated in FIG. 3, this reference leaf 1 without apertures, of given rectangular cross section 6, can be likened to a beam of height h and thickness e. It is known that the stiffness of such a beam is proportional to its moment of inertia I given by $I=h\cdot e^3/12$.

As illustrated in FIG. 4, if, to a first approximation, the influence of the bridges 5 is neglected, the leaf 2 of the hairspring according to the invention can be likened to a beam of height h' and of total thickness e', made up of two equidistant and symmetric portions 4 of thickness e" and separated by an aperture 3 passing through two opposing flat faces 7 of the portions 4. The two portions 4 are $e'-2\cdot e''$ apart. It is known that the stiffness of such a beam is proportional to its moment of inertia I' given by $I'=(h\cdot e'^3-h\cdot(e'-2\cdot e'')^3)/12$.

If the thickness e" of each of the portions 4 of the leaf 2 is equal to $e''=0.25\cdot e$, or in other words, if the mass of the leaf 1 is reduced by 50% (the mass of the bridges 5 being neglected to a first approximation), then in order to maintain the same stiffness, and therefore the same moment of inertia, that is to say in order to obtain I'=I, the total thickness e' of the leaf 2 has to be equal to $e'=0.05\cdot e$.

In general, for the same stiffness, that is to say in order to obtain I=I', the more the thickness e" of each of the two equidistant portions 4 of the leaf 2 is decreased, the more its total thickness e' is increased.

Figure 5:
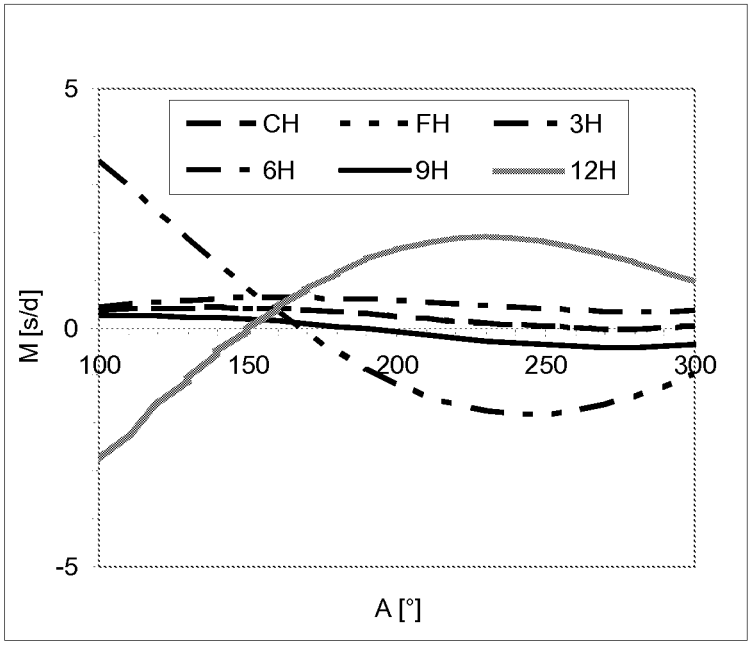
Fig. 5 PRIOR ART
FIG. 5 is an isochronicity diagram obtained using a hairspring the shape of the leaf of which corresponds to that of FIG. 1.

By way of example, in order to plot the isochronicity diagram of FIG. 5, use was made of a hairspring leaf with 17.25 turns and a radius of 3.3 mm, with a constant turn thickness e of e=45 μm, a pitch of 100 μm between two turns, and an end curvature of the outermost turn having an increased thickness e' given by $e'=1.5\cdot e$.

Figure 6:
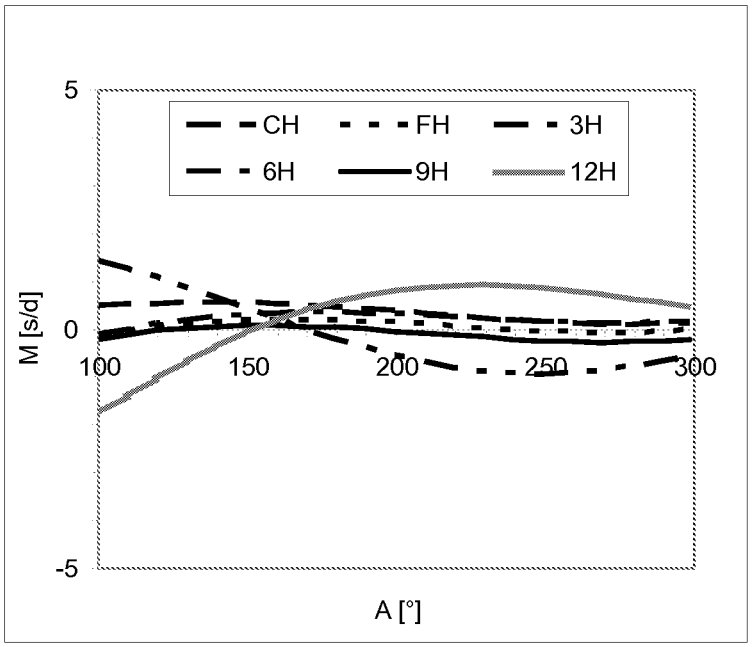
FIG. 6 depicts an isochronicity diagram obtained using a hairspring the shape of the leaf of which corresponds to that of FIG. 2.

By way of example, in order to plot the isochronicity diagram of FIG. 6, use was made of a hairspring leaf 2 according to the invention having the same stiffness as the previous leaf 1. In addition, the leaf 2 has apertures 3 made in such a way that bridges 5 are situated every 30° on the inner turns and every 15° on the outer turns and so that the thickness e" of the two equidistant portions 4 is given by $e''=0.25\cdot e$ and the total thickness e' of the leaf 2 is given by $e'=1.05\cdot e$.

Referring now more specifically to FIGS. 5 and 6, in the two isochronicity diagrams for the leaves 1 and 2 of the hairsprings that have the aforementioned features, the abscissa axis records the amplitude A of oscillation of the hairspring-balance mechanism, expressed in degrees, with respect to its position of equilibrium, and the ordinate axis records the operating discrepancy M obtained with the hairspring used, expressed in seconds per day.

These two isochronicity diagrams each depict six curves illustrating the operational discrepancy obtained with the leaf 1 in the case of the first diagram and with the leaf 2 in the case of the second, for six different conventional hairspring-balance mechanism measurement positions.

The discrepancy in operation between positions, in FIG. 5, is typically 3-4 s/d between 200° and 300° of amplitude with a value of 3.62 s/d at 250° for leaf 1 whereas, in FIG. 6, it is 1-2 s/d between 200° and 300° of amplitude with a value of 1.82 s/d at 250° for leaf 2.

Leaf 2 of the hairspring according to the invention therefore allows a significant reduction in the operating discrepancies of the regulating mechanism, halving them in this example.

Figure 7:
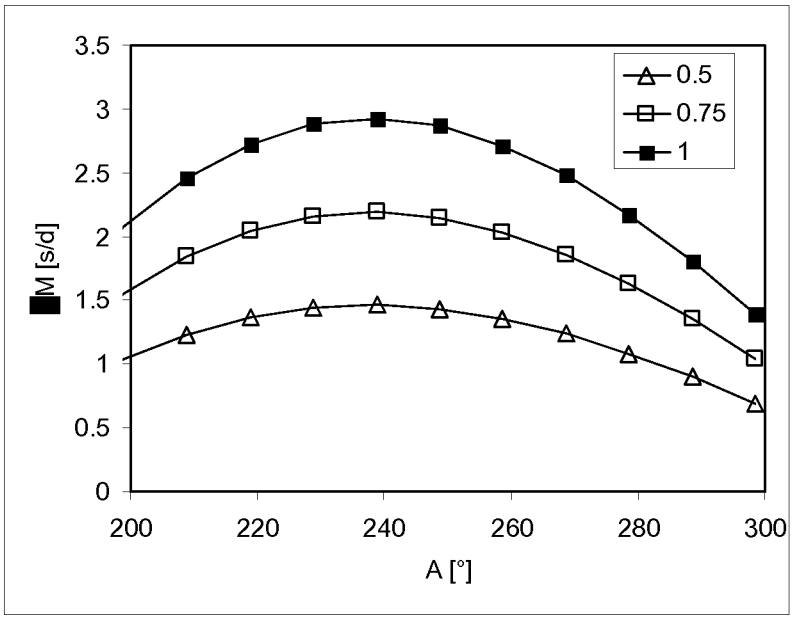
FIG. 7 is a diagram showing the maximum operating discrepancy ΔM between positions obtained using a hairspring the shape of the leaf of which corresponds to that of FIG. 1 and a hairspring the shape of the leaf of which corresponds to that of FIG. 2.

FIG. 7 illustrates the maximum operating discrepancy $\Delta M$ obtained firstly with a leaf 1 (the curve labeled "1") of a thermally compensated 14-turn hairspring 5 mm in diameter with a constant thickness of 44 μm and a pitch of 136 μm, and also with a leaf 2 according to the invention of a thermally compensated hairspring with an equivalent number of turns, diameter and stiffness, but with a mass of respectively 0.5 and 0.75 times the mass of the hairspring using leaf 1.

These show that the reduction in mass of the leaf leads to a near-linear reduction in the maximum operating discrepancy. Specifically, the three curves have more or less the same overall appearance. For each 25% reduction in the mass of the leaf, the maximum operating discrepancy of the hairspring is more or less reduced by 0.5 s/d at 200° of amplitude, and shows a reduction of comparable appearance irrespective of the amplitude of the hairspring-balance oscillator.

The shaping of the apertures 3 of the leaf 2 of the hairspring according to the invention is also advantageous for the thermal compensation of a variable-thickness leaf.

It is known that in order to achieve thermal compensation, that is to say minimize the thermal deviation in operation of a hairspring-balance oscillator equipped with a spiral hairspring, it is possible, in the case of silicon Si, to use a reference leaf 1 without apertures comprising a silicon core 10 enveloped in a layer 11 of external material, for example amorphous silicon dioxide $SiO_2$, as described in patent EP 1422436. The means for thermally compensating materials other than Si are known to those skilled in the art.

Figure 8:
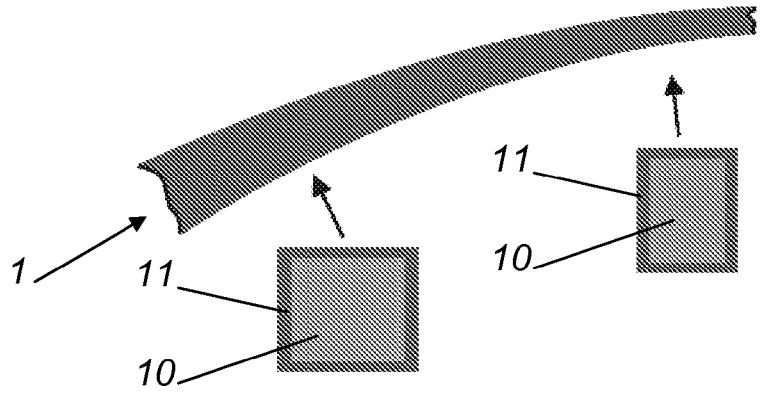
Fig. 8 PRIOR ART
FIG. 8 depicts part of the leaf of a hairspring of the prior art having a variable thickness.

Now, when the cross section of the leaf 1 of the hairspring changes, as it does, for example, in the case of a hairspring with variable turn pitch and thickness, the ratio between the dimensions of the core and of the layer 11 of external material changes also, as illustrated in FIG. 8, and this leads to thermal compensation that is non-optimized.

Figure 9:
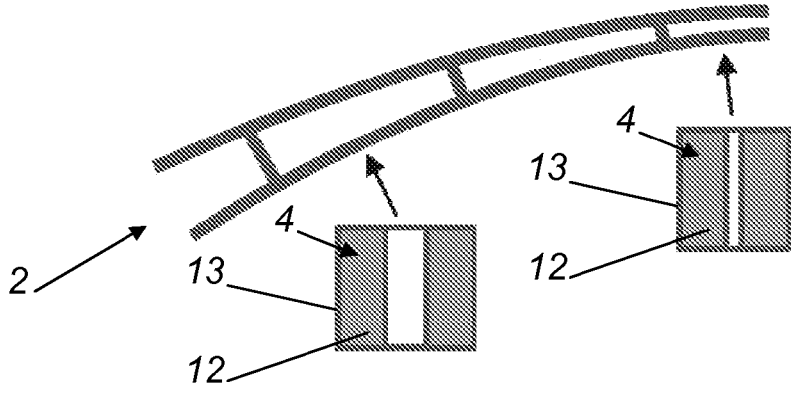
FIG. 9 depicts part of the leaf of a hairspring according to the invention having a variable thickness.

For a leaf 2 of variable total thickness e', formed of two equidistant portions 4 of constant thickness e" joined together by bridges 5, the ratio between the dimensions of the core 12 and of the layer 13 of external material advantageously remains constant along the entire length of the hairspring, even in those parts of the leaf 2 that exhibit a significant variation in total thickness e', as illustrated in FIG. 9.

That makes it possible to achieve optimized thermal compensation for the leaf 2.

In addition, because the oxidized surface is of greater area in the case of the leaf 2 with apertures, the thickness of $SiO_2$ needed to achieve thermal compensation is reduced by comparison with the thickness needed for the reference leaf 1 without apertures.

Because the leaf 2 according to the invention is of lower mass while having the same stiffness as the reference leaf 1 without apertures, it will be less sensitive to shocks.

The present invention could also be applied to a hairspring with variable pitch and thickness turns, like those described in application EP 2 299 336. It is also conceivable for the thickness of the portions to be varied together with their separation along the leaf. It is also possible for the two portions to display different thicknesses, or for use to be made of more than two portions connected by bridges. It is also possible to vary the spacing between the bridges. In addition, the thicknesses of each of the two portions of the leaf can also vary along the leaf, just as can their spacing. Furthermore, the two leaves may have different thicknesses and the ratio between these thicknesses may change along the length of the leaf.

These variants mean that the stiffness can be varied along the length of the leaf and/or that a stiffness can be obtained that varies with developed torque.

Other parameters can be altered in order further to optimize the chronometric properties of the hairspring, as FIGS. 12*a* to 12*e* show.

Figures 12A, 12B, 12C, 12D, 12E, 12F, 12G:
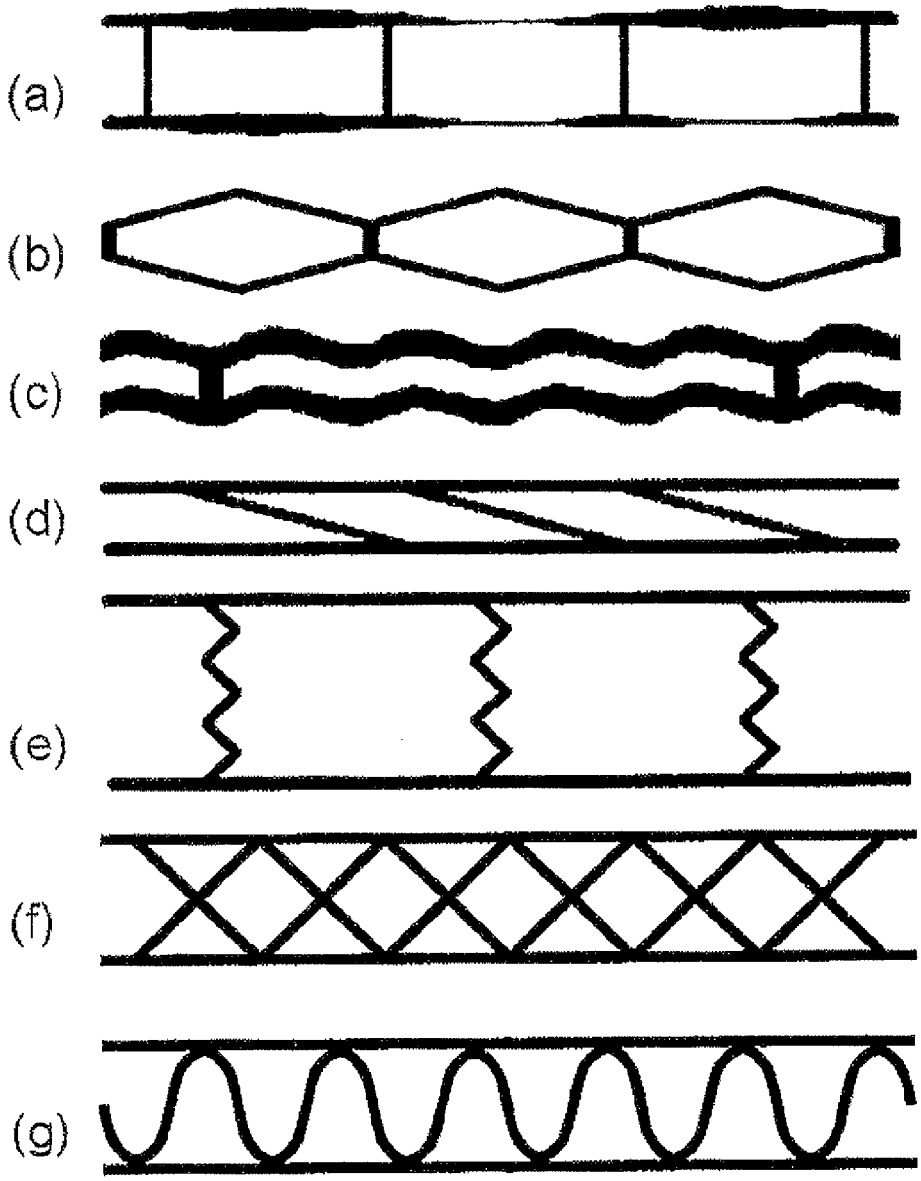
FIGS. 12*a* to 12*g* are alternative forms of embodiment.

FIG. 12*a* depicts a hairspring in which the leaf portions have a thickness that varies between the bridges, the purpose of this being to keep the maximum stresses in the cross section of the portions constant and to minimize the risks of leaf breakage.

FIG. 12*b* depicts a polygonal shape and FIG. 12*c* a wavy shape, the purpose of these shapes being to alter the compressibility of the internal portion, namely the side operating under compression upon bending, and thus influence the linearity of the elastic behavior. The objective of that is to avoid grossly non-linear effects due to buckling of the inner part. These shapes and variations can of course change along the length of the leaf, each leaf portion between two bridges being able to have its own structure.

It is also possible to alter the shape and orientation of the bridges and use bridges that are not directed perpendicular to the leaf, like the inclined bridges visible in FIG. 12*d* and/or to provide bridges which have a thickness and/or an orientation that varies between the two leaf portions, like the wavy bridges visible in FIG. 12*e*.

Finally, it is also conceivable to use bridges which are not directed at right angles to the leaf and which have the effect of increasing the stiffness of the leaf, as in FIG. 12*f* or in FIG. 12*g*.

The shape, dimensions and orientation of the bridges may thus have a more or less significant influence on the stiffness of the leaf. These parameters will also need to be taken into consideration on a case by case basis when optimizing the shape of the leaf so as to obtain concentric development of the hairspring and good hairspring-balance mechanism chronometric performance.

The hairsprings according to the invention are advantageously produced by microfabrication techniques such as DRIE (Deep Reactive Ion Etching) in the case of Si, quartz or diamond, or the UV-LiGA ("Lithographie, Galvanoformung, Abformung", or Lithography, Electroplating, Molding) method for alloys of the Ni or NiP type. It is also possible to use more conventional methods such as laser, water jet or electron discharge machining if the dimensions of the elements and the required tolerances so permit.

In other alternative forms of the present application that have not been depicted, the hairspring according to the invention could have a number of angularly offset leaves 2 which potentially could be joined together by an intermediate ring, as described and illustrated in patent application EP 2 151 722.

The invention claimed is:

1. A hairspring for a hairspring-balance oscillator, comprising at least one leaf the cross section of which has a thickness and a height, wherein said leaf comprises a plurality of apertures extending in the heightwise direction of the leaf and alternating with bridges.

2. The hairspring as claimed in claim 1, in which the leaf forms turns and the apertures are distributed at least over the entire length of a turn.

3. The hairspring as claimed in claim 2, in which the apertures are distributed over the entire length of the leaf.

4. The hairspring as claimed in claim 1, in which the apertures have an elongate shape and wherein the leaf comprises two equidistant portions joined to one another and separated by the apertures.

5. The hairspring as claimed in claim 1, in which the bridges are situated uniformly along the leaf.

6. The hairspring as claimed in claim 5, in which the angular spacing between the bridges is chosen to be between 5° and 360°.

7. The hairspring as claimed in claim 5, in which the angular spacing is 30° on the inner turns and 15° on the outer turns.

8. The hairspring as claimed in claim 1, in which the linear distance separating the bridges along the leaf is constant.

9. The hairspring as claimed in claim 1, in which the leaf has a total thickness that is constant along the turns.

10. The hairspring as claimed in claim 1, in which the leaf has a total thickness that varies along the turns.

11. The hairspring as claimed in claim 1, in which the leaf is made of silicon, of diamond or of quartz.

12. The hairspring as claimed in claim 1, in which the leaf comprises a core and a layer of external material envelops this core, the ratio between the dimensions of the core and of the layer of external material remaining constant along the leaf.

13. The hairspring as claimed in claim 12, wherein the core of the leaf is made of silicon and the layer of external material is made of silicon dioxide $SiO_2$.

14. The hairspring as claimed in claim 1, wherein the apertures are of circular or elliptical shape.

* * * * *